United States Patent [19]

Bradley

[11] Patent Number: 4,655,627

[45] Date of Patent: Apr. 7, 1987

[54] BRUSH WITH SELF-SEALING RESERVOIR HAVING A CONVERTIBLE ACTUATOR

[76] Inventor: George G. Bradley, 17 Elmora Ave., Elizabeth, N.J. 07202

[21] Appl. No.: 735,455

[22] Filed: May 17, 1985

[51] Int. Cl.[4] ..... A46B 11/02

[52] U.S. Cl. ..... 401/171; 401/172; 401/175; 401/64; 401/151; 401/278; 401/286

[58] Field of Search ..... 401/175, 286, 278, 171, 401/172, 64, 174, 151

[56] References Cited

U.S. PATENT DOCUMENTS

| | | | |
|---|---|---|---|
| 1,002,673 | 9/1911 | Goodwin et al. | 401/175 |
| 1,451,941 | 4/1923 | Clum | 401/175 |
| 2,323,378 | 7/1943 | Champion et al. | 401/286 |

FOREIGN PATENT DOCUMENTS

| | | | |
|---|---|---|---|
| 327002 | 7/1935 | Italy | 401/175 |
| 603327 | 3/1960 | Italy | 401/175 |
| 205125 | 8/1939 | Switzerland | 401/175 |
| 2067396 | 7/1981 | United Kingdom | 401/175 |

*Primary Examiner*—Steven A. Bratlie

*Attorney, Agent, or Firm*—Rohm & Monsanto

[57] ABSTRACT

A brush arrangement, specifically a toothbrush, is provided with a reservoir of cleaning material in its handle. The handle is hollow and provided with an actuatable plunger arrangement which pressurizes the cleaning material so as to force it through a channel and to the brush head. The pressurized cleaning material opens a pressure valve arrangement which exposes a dispensing port through which the cleaning material is dispensed in the vicinity of a plurality of bristles. The dispensing port is opened by the application of a force from the pressurized cleaning material which exceeds a counterforce applied by a resilient device, such as a spring. When the pressure in the reservoir is relieved, such as by reversing the direction of travel of the plunger, the counterforce applied by the spring is sufficient to ensure that the pressure valve closes the dispensing port. In certain embodiments, the brush arrangement is provided with a replaceable brush head. Also, cleaning material can be supplied to the brush arrangement by inserting refill cartridges which can be made disposable.

12 Claims, 5 Drawing Figures

BRUSH WITH SELF-SEALING RESERVOIR HAVING A CONVERTIBLE ACTUATOR

BACKGROUND OF THE INVENTION

This invention relates generally to brushes having a reservoir of a fluid, such as a cleaning fluid, joined therewith, and more particularly, to a brush, such as a toothbrush, wherein a self-sealing valve arrangement permits dispensing of a cleaning material, such as toothpaste, which is pressurized in a reservoir.

Conventional brush arrangements, particularly toothbrushes, require the application of a cleaning material, illustratively toothpaste, thereon from a separate dispensing container. Effective cleaning therefore requires a user to carry a brush and a separate container for the cleaning material.

With respect to toothbrushing, the conventional toothbrush and toothpaste tube which must accompany it are bulky and inconvenient to carry. Although the application of toothpaste onto a toothbrush does not seem inconvenient in the comfort of one's home, such is not the case when one is away from home, such as in a public rest room or a camp ground. The inconvenience of carrying the brush and the toothpaste tube, coupled with the additional inconvenience of removing the cap from the toothpaste tube, applying the toothpaste, replacing the cap, and replacing the toothpaste tube in one's pocket or purse has resulted in a situation where people do not brush as often as required to maintain healthy teeth and reduce dental expenses. There is, therefore, a need for a simple and convenient system for brushing one's teeth while away from home.

One commercially available toothbrush arrangement which is intended for use away from home is provided with a brush head and a hollow handle which contains a small, refillable tube of toothpaste. This known arrangement eliminates the inconvenience of carrying a separate tube of toothpaste. However, it has the disadvantage of requiring the end cap of the handle to be opened to permit removal of the small toothpaste tube which itself must be opened before the toothpaste can be applied to the brush.

It is, therefore, an object of this invention to provide a toothbrush arrangement wherein only one item need be carried by a user.

It is another object of this invention to provide a simple and inexpensive toothbrush with a toothpaste reservoir is arranged there within.

It is also an object of this invention to provide a simple and inexpensive toothbrush arrangement wherein the toothpaste contained within a reservoir is not exposed to the ambient environment, thereby preventing the toothpaste from drying.

It is a further object of this invention to provide a toothbrush arrangement wherein toothpaste stored therewithin can be used substantially entirely and with only minimal waste.

It is an additional object of this invention to provide a toothbrush arrangement having a replaceable brush portion.

It is also another object of this invention to provide a toothbrush arrangement wherein a single control is usable to activate both, dispensing of the toothpaste, and sealing of the reservoir.

It is still a further object of this invention to provide a toothbrush arrangement with a toothpaste reservoir having a high capacity.

It is yet another object of this invention to provide a toothbrush arrangement having a toothpaste reservoir therewithin wherein the toothpaste is not contaminated with water during rinsing.

It is additionally an object of this invention to provide a toothpaste arrangement wherein the toothpaste is dispensed in the vicinity of a brush head without requiring excess force or exertion by the user.

It is a still further object of this invention to provide a toothbrush arrangement having a toothpaste reservoir therewithin whereby the paste is dispensed without the need for disassembly.

SUMMARY OF THE INVENTION

The foregoing and other objects are achieved by this invention which provides a brush arrangement having a plurality of bristles thereon and a reservoir which is adapted for storing a cleaning material coupled thereto. An actuator arrangement is provided with a first portion for facilitating manipulation by a user, and a second portion which, in response to the first portion, applies a pressurizing force to the cleaning material within the reservoir. Thus, the pressurizing force can selectably be applied or relieved as desired by the user. In the vicinity of the brush head is arranged a pressure valve which permits dispensing of the cleaning material to the brush head only when the cleaning material is pressurized. When the pressure is relieved, the pressure valve closes a dispensing port in the brush head so as to prevent contamination or drying out of the cleaning material.

In one embodiment of the invention, the brush is a toothbrush, and the cleaning material is toothpaste. Such a brush head may be detachably coupled to the reservoir so as to permit replacement. The reservoir consists of an elongated chamber having a substantially constant cross-sectional internal configuration. The actuator, which pressurizes the cleaning material, or toothpaste, consists of a plunger which is configured to correspond to the interior of the reservoir, and is urged axially therealong by rotation of a threaded member engaged therewith. Since the plunger is fitted within the reservoir so as to seal against the interior surface of the reservoir, the axial displacement of the plunger causes pressurization of the toothpaste. In a preferred embodiment, the interior of the reservoir, and the plunger, are arranged to have a shape other than circular so as to prevent rotation of the plunger as the threaded member is turned.

In one embodiment of the invention, the pressure valve is formed of a sliding member which, when in a first position, closes the dispensing port at the brush head. A resilient biasing member, such as a spring, is arranged to urge the sliding member into its first position. The pressurized cleaning material, however, urges the sliding member into a second position where the dispensing port is open. In this manner, pressurization of the cleaning material results in the dispensing thereof at the dispensing port. Preferably, the spring applies a force sufficient to expel the cleaning material through the dispensing port when the pressure of the cleaning material has been reduced. In certain embodiments, the spring will urge some of the cleaning material back into the reservoir. Only an amount of the cleaning material sufficient to permit closure of the dispensing port is returned to the reservoir or expelled through the dispensing port.

In one highly advantageous embodiment of the invention, the reservoir is coupled via a channel to the brush head, and a shearing shoulder is provided at the juncture of the two. As the plunger is urged beyond the end of the reservoir, a shearing force is applied thereto sufficient to separate the periphery of the plunger from a central portion thereof. The central portion therefore can continue through the channel to insure that any of the cleaning material therein is pressurized and dispensed through the dispensing port so that it can be utilized. The plunger may be provided with a scored or otherwise weakened line at which such shearing is to occur.

In accordance with a further aspect of the invention, the reservoir is arranged in a disposable refill, which when the contents of the reservoir have been depleted, can be replaced with a fresh refill. A handle portion, which may be formed of a heavy-duty plastic, or a metal, is arranged to accommodate the refill and engage with resilient seals which may be formed integrally with the refill. The refill may be provided with a key or a slot which engages with a corresponding portion of the handle to prevent rotation of the refill therewithin when a threaded screw member is rotated to displace a plunger and thereby pressurize the cleaning material, as described hereinabove. Once the refill has been inserted into the handle, an end cap is installed which engages with the handle and also with the threaded rod to permit rotation thereof from the exterior of the handle by a user. Additionally, such a refillable embodiment may be provided with a replaceable brush head, as described above, and a protective cap for covering the brush head.

BRIEF DESCRIPTION OF THE DRAWING

Comprehension of the invention is facilitated by reading the following detailed description in conjunction with the annexed drawing, in which.

DETAILED DESCRIPTION OF THE INVENTION

Figure 1:
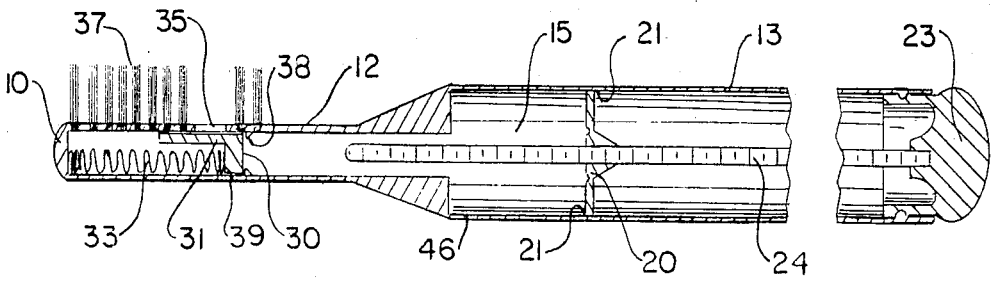
FIG. 1 is a simplified, partially schematic cross-sectional representation of one embodiment of the invention.

FIG. 1 is a simplified, partially schematic cross-sectional representation of a specific illustrative embodiment of the invention. The figure shows a toothbrush embodiment having a brush head 10 which is coupled via a channel portion 12 to a handle 13. Handle 13 is shown to be hollow and contains therewithin a reservoir 15 which holds a quantity of cleaning material, illustratively toothpaste. As will be discussed hereinbelow with respect to FIG. 2, the embodiment of FIG. 1 has a cross-sectionally noncircular handle. In this specific embodiment, the interior of the handle has an octagonal cross-sectional configuration.

A plunger 20 is arranged in handle 13 and defines one end of reservoir 15. The plunger is configured to have a shape which corresponds substantially to that of the interior cross section of the handle so as to be slidably in communication at edges 21 thereof. Plunger 20 is urged slidably along the interior of handle 13 by actuation of a knob 23 which is coupled to a threaded rod 24. In this specific embodiment, plunger 20 is threadably engaged with threaded rod 24 so as to be moved axially along the rod, and handle 13, in response to rotation of the threaded rod. The threaded rod is rotated by a user upon rotation of knob 23.

A cleaning material, such as toothpaste, which is stored in reservoir 15 is pressurized when plunger 20 is urged leftwardly in response to rotation of the knob and threaded rod. Thus, the cleaning material stored in reservoir 15 is urged through channel portion 12 so as to provide a force against a surface 30 of a valve member 31.

Valve member 31 is arranged to be movable leftwardly within the interior of brush head 10 in response to the force applied at surface 30. Such leftward movement compresses a resilient spring member 33. As long as the force applied by the pressurized cleaning material at surface 30 exceeds the resilient counterforce applied by spring member 33, the valve member will be displaced leftwardly so as to expose a dispensing port 35. In this embodiment, dispensing port 35 is essentially a through-aperture in the wall of brush head 10, and preferably is arranged so that any cleaning material exiting therethrough will be deposited in the vicinity of a plurality of bristles 37.

Figure 2:
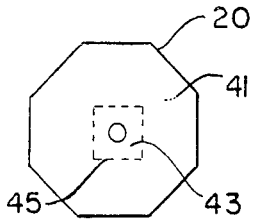
FIG. 2 is a plan view of a plunger which is suitable for use in the embodiment of FIG. 1.

FIG. 2 is a plan view of plunger 20 showing an outer region 41 and an inner region 43. Regions 41 and 43 are separated from one another by a scored line 45 which is intended to provide a weakened region where the outer and inner regions can be separated from one another. In this specific illustrative embodiment, plunger 20 is urged leftwardly in response to rotation of threaded rod 24, until the plunger reaches shoulders 46 in reservoir 15. Continued rotation of threaded rod 24 so as to urge plunger 20 further leftward of shoulder 46 causes outer region 41 of the plunger to break from inner region 43 at scored line 45, so that the inner region can continue leftward into channel portion 12. In this manner, usage of cleaning material is maximized and only a small amount of waste results.

In the practice of the invention, spring member 33 should provide sufficient rightwardly directed force to valve member 31 so that when plunger 20 is stationary, or moved slightly rightwardly, surface 30 of the valve member provides a sufficient rightward force to effect closure of the dispensing port. Thus, the cleaning material in channel portion 12 will not be exposed to ambient condition, so as not to dry out, and neither will water enter the dispensing port when the brush head is rinsed. Rightward travel of valve head 31 is limited by an anchor stop 38, which may be formed integrally with the brush head. Preferably, an edge 39 of the valve member sealingly engages with the internal surface of brush head 10 to prevent the cleaning material from entering the region where spring member 33 is located. Additionally, anchor stop 38 may be used to improve the seal between the valve member and the inner surface of the brush head.

Figure 3:
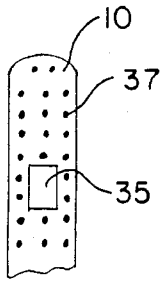
FIG. 3 is a top plan view of a brush head showing an illustrative dispensing port.

FIG. 3 is a top plan view of brush head 10 showing a specific illustrative arrangement of bristles 37 and dispensing port 35. As shown, any cleaning material dispensed at dispensing port 35 will be deposited in the region of the bristles.

Figure 4:
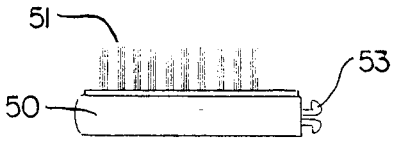
FIG. 4 is a side view of a brush head which is detachable and replaceable.

FIG. 4 is a side view of a replaceable brush head 50 having bristles 51 and an engagement arrangement 53. In this specific illustrative embodiment, engagement arrangement 53 is shown to be of the resilient snap-in type. However, any other type of coupling arrangement, such as a screw threaded collar (not shown) or a locking pin arrangement (not shown) can be used in the practice of the invention.

Figure 5:
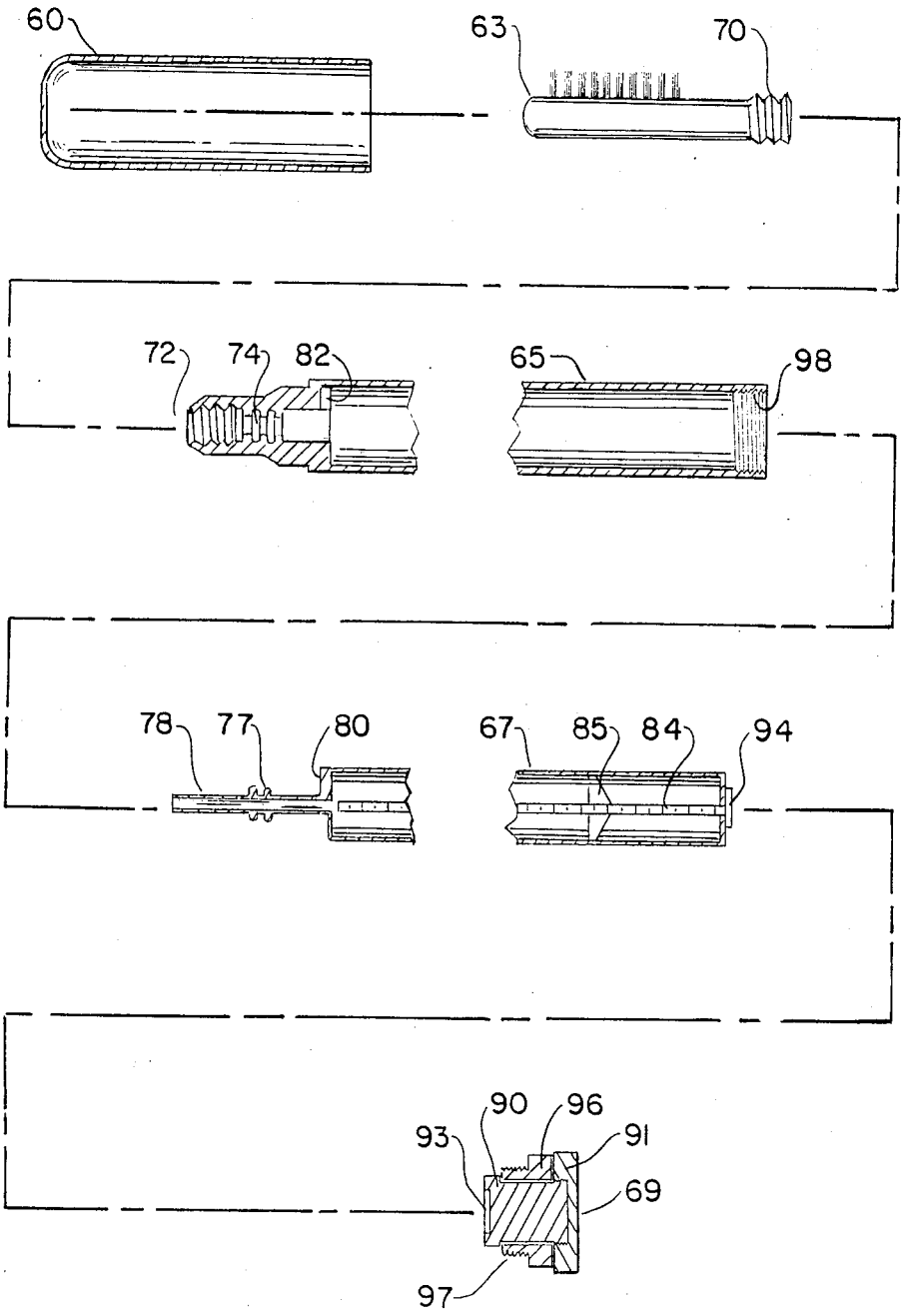
FIG. 5 is a partially cross-sectional, exploded plan view of a refillable embodiment with a replaceable brush head.

FIG. 5 is a partially cross-sectional representation of a refillable embodiment of the invention shown in a disassembled state. The figure shows, in sequence, a protective cap 60, a replaceable brush head 63, a handle member 65, a refill arrangement 67, and an end cap arrangement 69. Replaceable brush head 63 is arranged internally as described hereinabove so as to have a valve member which is urged in a direction which closes a dispensing port by a spring member. In this embodiment, however, brush head 63 is provided with a screw-threaded region 70 which is intended to engage with an internally threaded region 72 of handle member 65.

Handle member 65 is formed of a sturdy plastic material, or a metal, and is also provided with a seal engagement region 74. Seal engagement region 74 is arranged to couple with resilient seal ribs 77 arranged on nozzle 78 of refill arrangement 67. Thus, when refill arrangement 67 is inserted into the interior of handle member 65, the resilient seal ribs engage sealingly with corresponding ribs at seal engagement region 74 to prevent any cleaning material which is urged out through nozzle 78 from flowing into the interior of handle member 65. Nozzle 78, when brush head 63 is installed on handle member 65, penetrates at least partially into the replaceable brush head, and therefore extends beyond internally threaded region 72. In this manner, the refill arrangement can be removed easily from the handle member by removing brush head 63 and applying a force at the tip of nozzle 78.

Refill arrangement 67 is further provided with a key protrusion 80 which engages with a corresponding slot 82 in the interior of the handle member. Such engagement prevents rotation of the refill arrangement when a rod 84 is rotated to displace axially a plunger 85, as described hereinabove.

Rod 84 is rotated by manipulation of end cap arrangement 69. In this embodiment, the end cap arrangement is formed of a coupling portion 90 which is threadedly engaged with a manipulation portion 91. Coupling portion 90 is provided with a slot 93 which engages with an actuation member 94 which is coupled to rod 84. A rotatable ring 96 is arranged with a screw threaded portion 97 which couples with internal threads 98 of handle member 65.

Although the invention has been disclosed in terms of specific embodiments and applications, persons skilled in the art can, in light of this teaching, generated additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A brush arrangement having a brush head with a plurality of bristles thereon, the brush head further comprising:

reservoir means adapted for storing a fluid, said reservoir means being provided with an end stop and coupled to the brush head whereby said fluid is dispensed in the vicinity of the brush head;

channel means interposed between said reservoir means and the brush head for providing a flow path therebetween for said fluid;

actuator means having a first portion for manipulation by a user, and a second portion for communicating with said fluid in said reservoir means and being displaceable in response to said manipulation of said first portion for applying a pressurizing force which pressurizes said fluid, said pressurizing force being responsive to a displacement of said second portion, said second portion cooperating with said end stop of said reservoir means for reducing a dimension of said second portion whereby a remaining portion thereof having a reduced dimension is urged through a portion of said channel means in response to said manipulation; and pressure valve means arranged in the vicinity of the brush head and responsive to said pressurizing force applied by said second portion of said actuator means for opening a port whereby an amount of said fluid responsive to said displacement of said second portion of said actuator means is dispensed.

2. The brush arrangement of claim 1 wherein there is further provided detachable coupling means for detachably coupling said reservoir means and the brush head to one another.

3. The brush arrangement of claim 1 wherein said actuator means comprises a screw-threaded member for coupling said first and second portions, said first portion being located at one end thereof and adapted for facilitating rotation of said screw-threaded member, and said second portion being threadedly engaged with said screw-threaded member and being displaceable axially therealong in response to said rotation of said screw-threaded member.

4. The brush arrangement of claim 3 wherein said second portion is configured to correspond substantially to the interior of said reservoir means, and is substantially sealed circumferentially therewithin.

5. The brush arrangement of claim 4 wherein said interior of said reservoir means is cross-sectionally non-circular to prevent rotation of said second portion.

6. The brush arrangement of claim 1 wherein there is further provided shearing means at said end stop of said reservoir means for shearing said second portion of said actuator means to reduce its size.

7. The brush arrangement of claim 1 wherein said pressure valve means comprises:

a sealing member being displaceable between a first position where said port is closed, and a second position where said port is open; and resilient biasing means for urging said sealing member toward said first position.

8. A toothbrush, comprising:

brush head means having a multiplicity of bristles extending therefrom and a dispensing port in the vicinity of said bristles;

valve means having a first position for closing said dispensing port and a second position for opening said dispensing port;

resilient means for urging said valve means toward said first position;

channel means for receiving a pressurized cleaning material which communicates with said valve means, said valve means being urged toward said second position in response to a pressure applied by said pressurized cleaning material;

reservoir means for storing said cleaning material, said reservoir means being coupled to said channel means; and actuatable means for selectably applying and removing a pressurizing force on said cleaning material, said actuatable means having an extension member detachably coupled thereto, whereby said actuatable means is dimensioned to correspond to an internal dimension of said reservoir means when said extension member is coupled thereto, and is dimensioned to correspond to an internal dimension of said channel means when said extension member is detached.

9. The toothbrush of claim 8 wherein said reservoir means comprises an elongated chamber having a substantially constant internal cross-sectional configuration with respect to axial length of said internal dimension.

10. The toothbrush of claim 9 wherein said actuatable means comprises:

plunger means having a shape corresponding to said internal cross-sectional configuration of said elongated chamber and being displaceable along said axial length of said elongated chamber; and a rotatable threaded rod for urging said plunger means along said axial length of said elongated chamber.

11. The toothbrush of claim 10 wherein said plunger means is arranged to have a shearable outer edge forming said extension member whereby a remaining portion of said plunger means is provided for accommodation in said channel means for dispensing said cleaning material therein.

12. The toothbrush of claim 10 wherein there is further provided handle means coupled to said channel means for enclosing said reservoir means.

* * * * *